US010753351B2

(12) United States Patent
Hong

(10) Patent No.: US 10,753,351 B2
(45) Date of Patent: Aug. 25, 2020

(54) AIR INFLATING DEVICE AND TIRE REPAIR MACHINE COMPRISING SAME

(71) Applicant: ACTIVE TOOLS INTERNATIONAL (HK) LTD., Hong Kong (CN)

(72) Inventor: David Ying Chi Hong, Hong Kong (CN)

(73) Assignee: ACTIVE TOOLS INTERNATIONAL (HK) LTD., Hong Kong (CN)

( * ) Notice: Subject to any disclaimer, the term of this patent is extended or adjusted under 35 U.S.C. 154(b) by 233 days.

(21) Appl. No.: 15/757,335

(22) PCT Filed: Sep. 2, 2015

(86) PCT No.: PCT/CN2015/088820
§ 371 (c)(1),
(2) Date: Mar. 2, 2018

(87) PCT Pub. No.: WO2017/035805
PCT Pub. Date: Mar. 9, 2017

(65) Prior Publication Data

US 2018/0238314 A1 Aug. 23, 2018

(51) Int. Cl.
*F04B 39/06* (2006.01)
*F04B 39/12* (2006.01)
(Continued)

(52) U.S. Cl.
CPC ..... *F04B 39/066* (2013.01); *F04B 35/01* (2013.01); *F04B 35/04* (2013.01); *F04B 39/121* (2013.01);
(Continued)

(58) Field of Classification Search
CPC ..... F04B 35/01; F04B 35/04; F04B 39/127; F04B 39/121; F04B 41/00; F04B 2205/05; F04B 39/066; F04B 39/123
See application file for complete search history.

(56) References Cited

U.S. PATENT DOCUMENTS 5,378,119 A * 1/1995 Goertzen ..... F04B 35/04 312/236
6,789,581 B2 9/2004 Cowan et al.
(Continued)

FOREIGN PATENT DOCUMENTS

CN 2592893 Y 12/2003
CN 1704584 A 12/2005
(Continued)

OTHER PUBLICATIONS

International Search Report, dated May 25, 2016 for corresponding International Application No. PCT/CN2015/088820.
(Continued)

*Primary Examiner* — Charles G Freay
(74) *Attorney, Agent, or Firm* — Intellectual Property Law Group LLP

(57) ABSTRACT

The present application provides an air inflation device and a tire repair machine comprising the air inflating device. The air inflating device comprises a housing (1), a compressor device (2) including a compressor main body (21), and an outlet nozzle (22) that is connected to the compressor main body (2) as a compressed air discharge opening; the compressor device (2) is stored in the housing (1), and the housing (1) is divided into a second chamber (11) and a third chamber (12) by the compressor device (2); a fan (212) and the outlet nozzle (22) are located in the second chamber (11). The air inflating device and the tire repair machine of the present application have a simple structure and a strong practicality.

20 Claims, 4 Drawing Sheets

(51) Int. Cl.

| | |
|---|---|
| ***F04B 41/00*** | (2006.01) |
| ***F04B 35/04*** | (2006.01) |
| ***F04B 35/01*** | (2006.01) |

(52) U.S. Cl.

CPC ..... *F04B 39/123* (2013.01); *F04B 39/127* (2013.01); *F04B 41/00* (2013.01); *F04B 2205/05* (2013.01)

(56) References Cited

U.S. PATENT DOCUMENTS

| | | | | |
|---|---|---|---|---|
| 7,547,201 | B2 * | 6/2009 | Chou | B29C 73/166 277/438 |
| 7,789,110 | B2 | 9/2010 | Marini | |
| 8,016,002 | B2 | 9/2011 | Yoshida et al. | |
| 8,684,046 | B2 | 4/2014 | Kojima et al. | |
| 8,752,595 | B2 | 6/2014 | Marini et al. | |
| 8,997,801 | B2 | 4/2015 | Kojima et al. | |
| 2007/0065311 | A1 | 3/2007 | Chou | |
| 2013/0199666 | A1 | 8/2013 | Nakao et al. | |
| 2013/0228316 | A1 | 9/2013 | Hong | |
| 2015/0147208 | A1 * | 5/2015 | Chen | F04B 39/066 417/423.8 |

FOREIGN PATENT DOCUMENTS

| | | | |
|---|---|---|---|
| CN | 2851637 | Y | 12/2006 |
| CN | 201539387 | U | 8/2010 |
| CN | 201972885 | U | 9/2011 |
| CN | 202926547 | U | 5/2013 |
| DE | 202015102573 | * | 5/2015 |
| EP | 2497627 | A1 | 9/2012 |
| JP | 2012219780 | A | 11/2012 |

OTHER PUBLICATIONS

Written Opinion of the ISA, dated May 18, 2016 for corresponding International Application No. PCT/CN2015/088820.

* cited by examiner

AIR INFLATING DEVICE AND TIRE REPAIR MACHINE COMPRISING SAME

CROSS-REFERENCE TO RELATED APPLICATIONS

This application is a U.S. National Phase application, under 35 U.S.C. § 371, of International Application no. PCT/CN/2015/088820, with an international filing date of Sep. 2, 2015, which is hereby incorporated by reference for all purposes.

TECHNICAL FIELD

The present application relates to a field of tire repair products, and more particularly relates to an air inflation device and a tire repair machine comprising the air inflating device.

BACKGROUND ART

In an existing tire repair machine, an air inflating device usually takes up a large space. Moreover, an air compressed process of the air inflating device is exothermic, and heat generated during the air compressed process cannot be dissipated quickly, which will prolong tire inflation time.

In a conventional compressor mechanism, for example, in U.S. Pat. Nos. 8,016,002 B2, 7,547,201 B2, 8,684,046 B2, 8,997,801 B, US20130199666 A1, U.S. Pat. No. 6,789,581 B2 and EP2497627 A1, a hot spot such as an outlet nozzle connected to a compression chamber is located far away from a fan on a motor. On top of that, air paths for heat dissipation and an air intake for compression are not optimized, so that interference between the air paths exists.

Moreover, in U.S. Pat. Nos. 8,752,595 B2 and 7,789,110 B2, components in some available products are closely packed. There is no description about air flow within the compressor. Besides, there is barely enough room for air flowing from/to ventilation holes. Thus, heat dissipation of the compressor is not optimized.

In additions, some compressors have a heat dissipation structure, particularly, a housing with ventilation holes and directed air flow. However, the distance between the fan on the motor and the hot spot is not minimized. The air intake for heat dissipation and air intake for air compression is from the same ventilation holes, as shown in US 2013 0228316 A1.

SUMMARY OF INVENTION

The objective of the present application is to provide an air inflation device and a tire repair machine comprising the air inflating device, aiming at defects that an air inflating device usually takes up a large space in an existing tire repair machine; and an air compressed process cannot be dissipated quickly, which will prolong tire inflation time process of the air inflating device is exothermic, and heat generated during the air compressed and result in a undesired high surface temperature.

SOLUTION TO PROBLEM

Technical Solution

The technical solutions of the present application for solving the technical problems are as follows:

in one aspect, an air inflating device is provided, which comprises:

a housing, a compressor device including:

a compressor main body configured for generating compressed air, an outlet nozzle that is connected to the compressor main body as a compressed air discharge opening, and a pressure gauge configured for measuring a pressure of the compressed air from the compressor main body;

wherein the compressor main body includes:

a motor, a fan mounted on the motor, a first bevel gear driven by the motor, a second bevel gear engaging with the first bevel gear, a piston driven by the second bevel gear via a connecting rod, and a cylinder equipped with the piston in a reciprocal manner and forming a first chamber for compressing air inside to generating compressed air;

the outlet nozzle is connected to the first chamber; the compressor device is stored in the housing, and the housing is divided into a second chamber and a third chamber by the compressor device; the fan and the outlet nozzle are located in the second chamber.

In one embodiment, the housing has one or more ventilation holes for air from surrounding to enter and leave the second chamber.

In another embodiment, the housing has one or more air intake holes to take air from surrounding to the first chamber.

In another embodiment, the compressor main body further includes a bearing and a second rotation shaft; the outer ring of the bearing is mounted on the housing, and the second rotation shaft is fixed in the inner ring of the bearing axially; the second bevel gear is mounting on the second rotation shaft axially, and the second rotation shaft is perpendicular to the first rotation shaft.

In another embodiment, a load is mounted on the second bevel gear or the second rotation shaft; and the connecting rod is eccentrically mounted on the load.

In another embodiment, the first bevel gear and the second bevel gear have a shaft angle of 45-120 degrees.

In another embodiment, the air inflating device further comprises a separation barrier that is arranged in the housing; and the separation barrier has a second fixing hole and a third fixing hole; and the motor is arranged in the second fixing hole, and the cylinder is arranged in the third fixing hole; the second chamber and the third chamber are separated completely via the separation barrier and the compressor device.

In another aspect, an air inflating device comprises:

a housing, a compressor device including:

a compressor main body configured for generating compressed air, an outlet nozzle that is connected to the compressor main body as a compressed air discharge opening, and a pressure gauge configured for measuring a pressure of the compressed air from the compressor main body;

wherein the compressor main body includes:

a motor, a fan mounted on the motor, a first helical gear driven by the motor, a second helical gear engaging with the first helical gear, a piston driven by the second helical gear via a connecting rod, and a cylinder equipped with the piston in a reciprocal manner and forming a first chamber for compressing air inside to generating compressed air;

the outlet nozzle is connected to the first chamber; the compressor device is stored in the housing, and the housing is divided into a second chamber and a third chamber by the compressor device; the fan and the outlet nozzle are located in the second chamber.

In one embodiment, the housing has one or more ventilation holes for air from surrounding to enter and leave the second chamber.

In another embodiment, the housing has one or more air intake holes to take air from surrounding to the first chamber.

In another embodiment, the compressor main body further includes a bearing and a second rotation shaft; the outer ring of the bearing is mounted on the housing, and the second rotation shaft is fixed in the inner ring of the bearing axially; the second helical gear is mounting on the second rotation shaft axially, and the second rotation shaft is perpendicular to the first rotation shaft.

In another embodiment, a load is mounted on the second helical gear or the second rotation shaft; and the connecting rod is eccentrically mounted on the load.

In another embodiment, further comprises a separation barrier that is arranged in the housing; and the separation barrier has a second fixing hole and a third fixing hole; and the motor is arranged in the second fixing hole, and the cylinder is arranged in the third fixing hole; the second chamber and the third chamber are separated completely via the separation barrier and the compressor device.

In another aspect, a tire repair machine comprising the air inflating device is provided.

In another aspect, an manufacturing method of an air inflating device to inflate air into a tire is provided, the air inflating device comprises a fan mounted on a motor, a compressor main body driven by the motor and configured for generating compressed air, an outlet nozzle serving as a compressed air discharge opening and a housing accommodating the fan, the motor, the compressor main body and the outlet nozzle;

the manufacturing method comprises dividing the housing into a second chamber and a third chamber to make an air compression process of the compressor main body be done in the third chamber, and making the fan and the outlet nozzle be located in the second chamber and be aligned in a straight line, so that air flow generated by the fan cools the outlet nozzle directly;

the manufacturing method further comprises setting one or more ventilation holes on the second chamber to make the one or more ventilation holes and the second chamber form an air flow path for air from surrounding to enter and leave the second chamber, and setting one or more air intake holes on the third chamber to take air from surrounding to the first chamber.

Advantageous Effects of Invention

Advantageous Effects

The air inflating device and the tire repair machine of the present application adopt a compressor device as an air inflating mechanism, which reduces the volume of the air inflation device; and in the compressor device, an outlet nozzle and a piston are separated, which promote heat dissipation of the air inflating device. The air inflating device and the tire repair machine of the present application has a simple structure and a strong practicality.

BRIEF DESCRIPTION OF DRAWINGS

Description of Drawings

Figure 1:
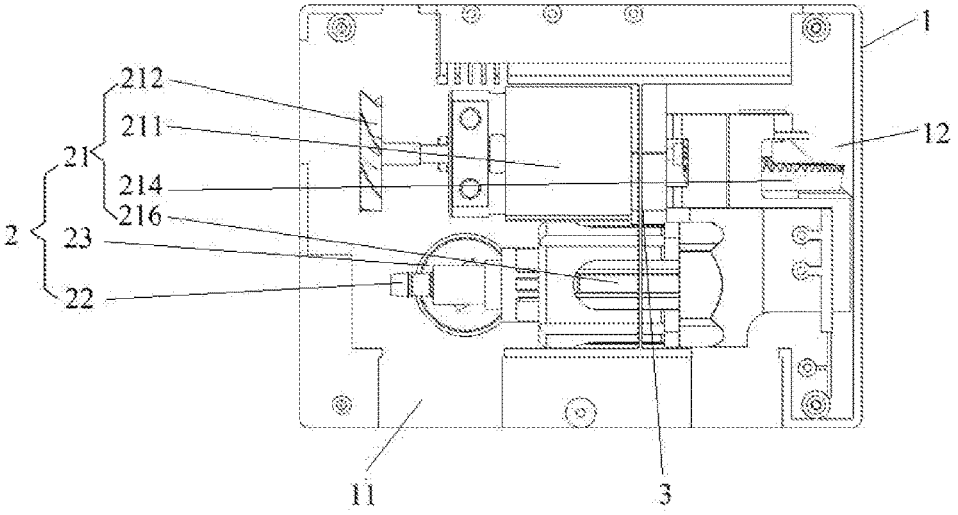
Figure 2:
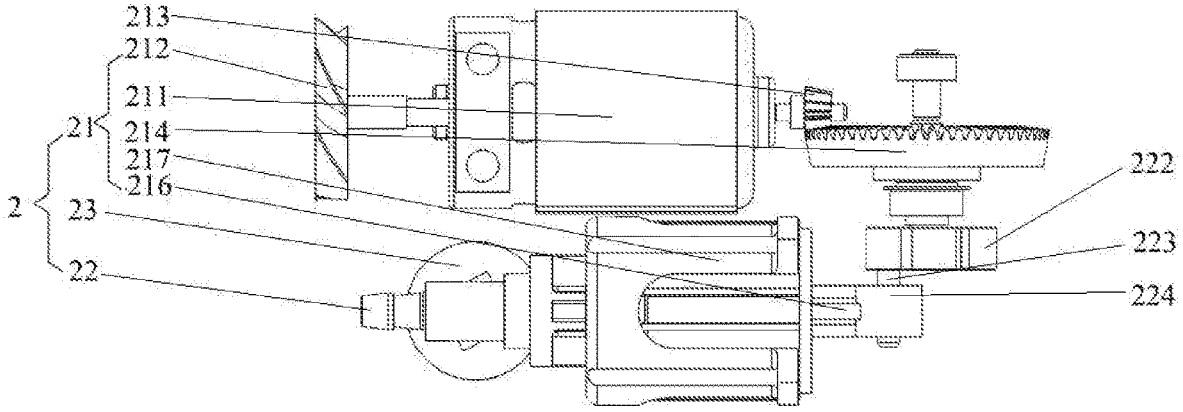
Figure 3:
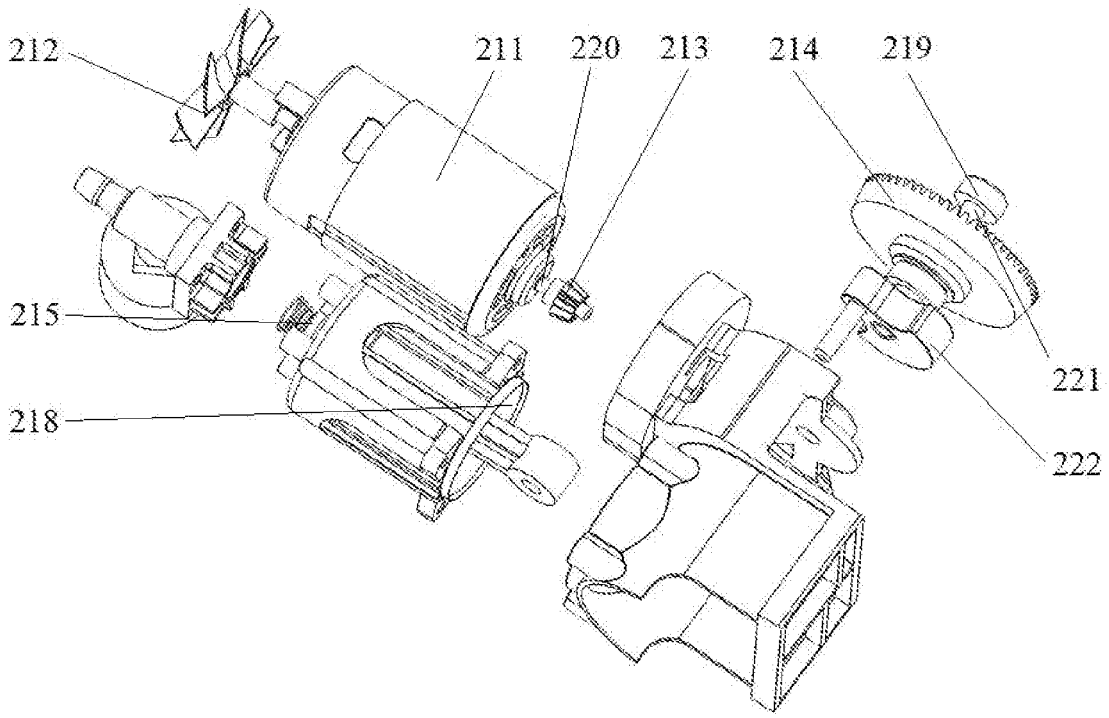
Figure 4:
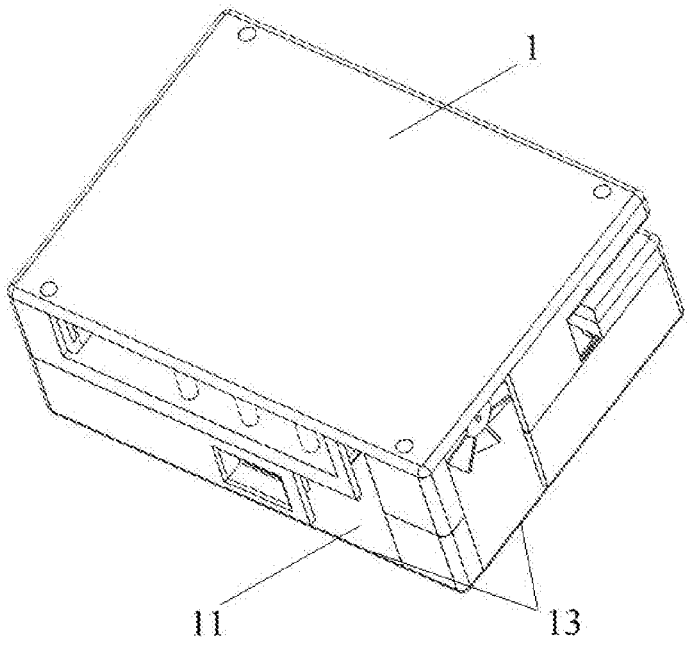
Figure 5:
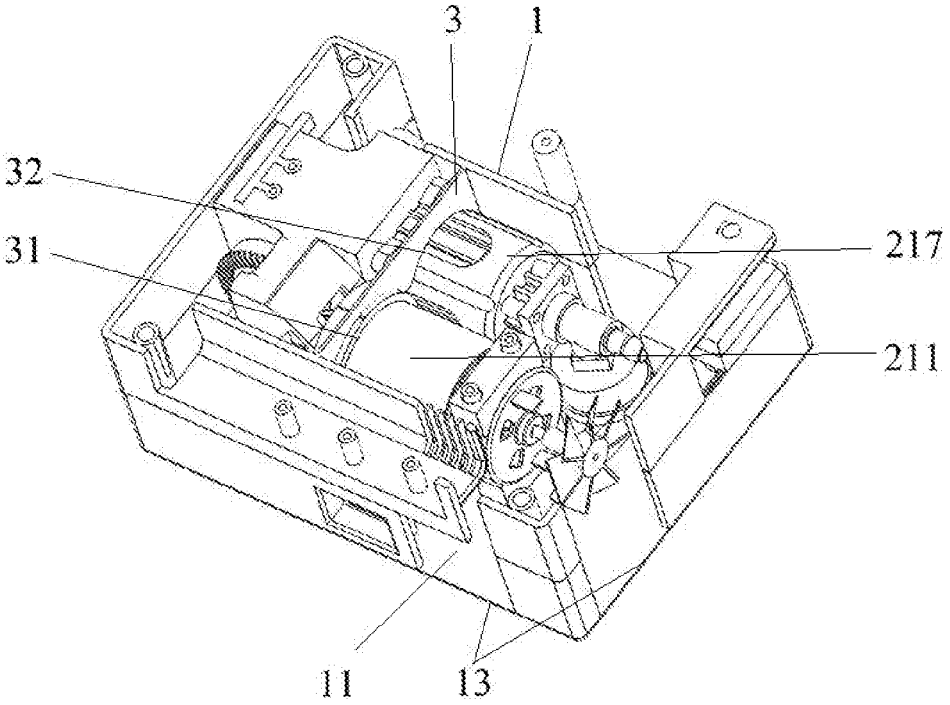
Figure 6:
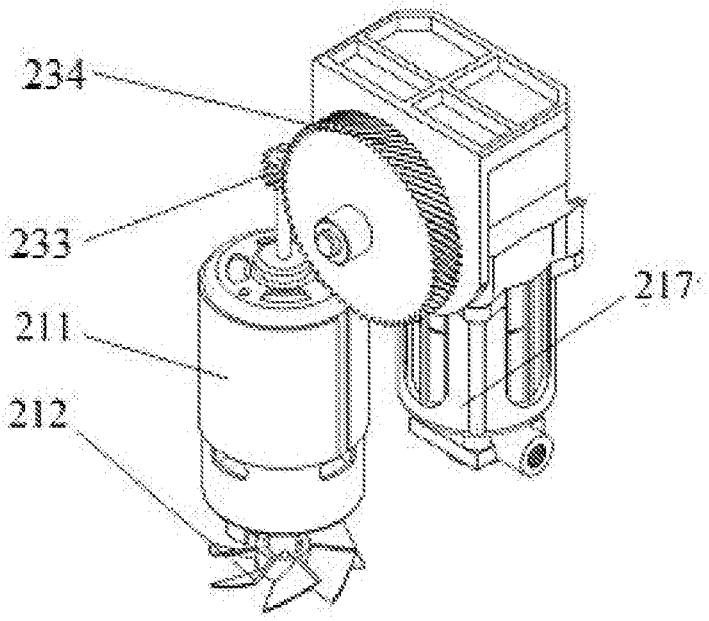
Figure 7:
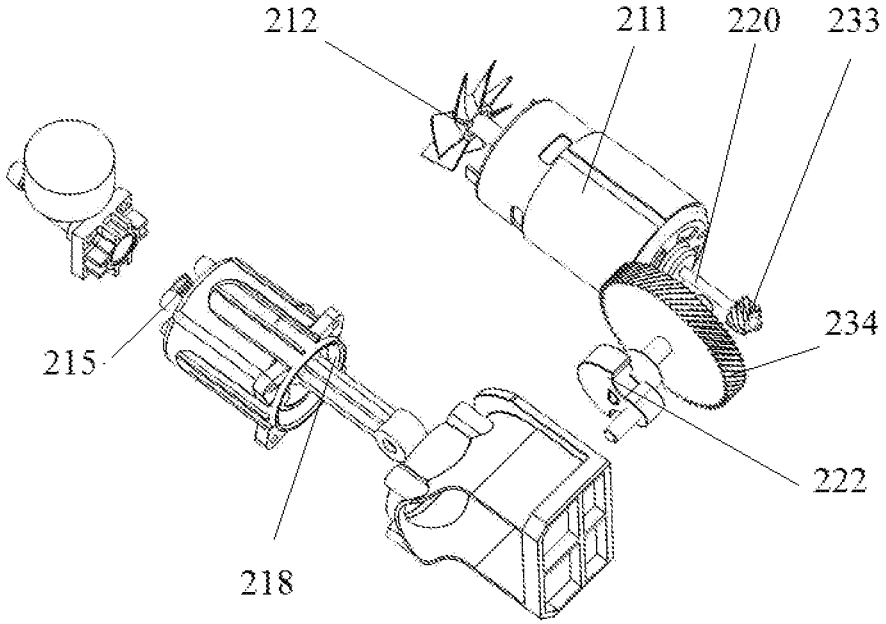

FIG. 1 is a schematic view of the air inflation device of an embodiment of the present application;

FIG. 2 is a schematic view of the compressor device of the air in inflation device shown in FIG. 1;

FIG. 3 is an exploded view of the compressor device shown in the FIG. 2;

FIG. 4 is an outer structural schematic view of the air inflating device shown in FIG. 1;

FIG. 5 is an inner structural schematic view of the air inflating device shown in FIG. 1;

FIG. 6 is a schematic view of the air inflation device of another embodiment of the present application; and FIG. 7 is an exploded view of the compressor device shown in the FIG. 6.

DETAILED DESCRIPTION OF SPECIFIC EMBODIMENTS

Mode for Invention

The objective of the present application is to provide an air inflation device and a tire repair machine comprising the air inflating device, aiming at defects that an air inflating device usually takes up a large space in an existing tire repair machine; and an air compressed process of the air inflating device is exothermic, and heat generated during the air compressed process cannot be dissipated quickly, which will prolong tire inflation time. The technical solution provided by the present application is to provide a compressor device as an air inflating mechanism of the air inflation device, which reduces the volume of the air inflation device; and in the compressor device, an outlet nozzle and a piston are separated, which promote heat dissipation of the air inflating device.

To make the technical feature, objective and effect of the present application be understood more clearly, now the specific implementation of the present application is described in detail with reference to the accompanying drawings and embodiments.

As shown in FIGS. 1-3, FIG. 1 is a schematic view of the air inflation device of an embodiment of the present application; FIG. 2 is a schematic view of the compressor device of the air in inflation device shown in FIG. 1; and FIG. 3 is an exploded view of the compressor device shown in the FIG. 2.

In FIG. 1, the air inflating device comprises a housing 1 and the compressor device 2; and the compressor device 2 is stored in the housing 1.

In FIGS. 1-3, the compressor device 2 includes a compressor main body 21 configured for generating compressed air, an outlet nozzle 22 that is connected to the compressor main body 21, and a pressure gauge 23 configured for measuring a pressure of the compressed air from the compressor main body 21, wherein the outlet nozzle 22 serves as a compressed air discharge opening, and the compressed air from the compressor main body 21 is pumped out through the outlet nozzle 22.

Furthermore, in FIGS. 1-3, the compressor main body 21 includes a motor 211, a fan 212 mounted on the motor 211, a first bevel gear 213 driven by the motor 211, a second bevel gear 214 engaging with the first bevel gear 213, a piston 215 driven by the second bevel gear 214 via a connecting rod 216, and a cylinder 217 equipped with the piston 215 in a reciprocal manner and forming a first chamber 218 for compressing air inside to generating compressed air;

Specifically, in the embodiment, in FIG. 3, the motor 211 includes a first rotation shaft 220, and the first bevel gear 213 is mounted on the first rotation shaft 220 coaxially. When the motor 211 is working, the first rotation shaft 220 drives the first bevel gear 213 to rotate. Moreover, the fan 212 and the first bevel gear 213 are arranged on two opposite sides of the motor 211. Advantageously, in the present embodiment, two end portions of the first rotation shaft 220 respectively extends out of the motor 211, and the fan 212 is mounted on the one end portion of the first rotation shaft 220 coaxially, and the first bevel gear 213 is mounted on the other end portion of the first rotation shaft 220 coaxially. When the motor 211 is working, the first rotation shaft 220, the fan 212 and the first bevel gear 213 rotate at the same angular speed. In some embodiments, the fan 212 may be fixed on the motor 211 via some fixing parts, and be driven by another power mechanism.

Furthermore, in FIG. 3, the compressor main body 21 further includes a bearing 219 and a second rotation shaft 221, wherein the outer ring of the bearing 219 is mounted on the housing 1, and the second rotation shaft 221 is fixed in the inner ring of the bearing 219 axially. Moreover, the second bevel gear 214 is mounting on the second rotation shaft 221 axially, and the second rotation shaft 221 is perpendicular to the first rotation shaft 220. Thus, the first bevel gear 213 can drive the second bevel gear 214 and the second rotation shaft 221 to rotate. In another embodiment, the first bevel gear 213 and the second bevel gear 214 have a shaft angle of 45-120 degrees.

Furthermore, in FIGS. 2 and 3, a load 222 is mounted on the second bevel gear 214 or the second rotation shaft 221; and the connecting rod 216 is eccentrically mounted on the load 222. In the present application, the load 222 is mounted on the second rotation shaft 221; and the load 222 includes a transfer bar 223, and the transfer bar 223 is eccentrically disposed on the main body of the load 222; and the connecting rod 216 has a first connecting end portion 224 with a first fixing hole (not shown); the transfer bar 223 is fixed in the first fixing hole; the piston 215 is mounted on a second connecting end portion (not shown) of the connecting rod 216. When the second rotation shaft 221 rotates, the load 222 is driven to rotate, which drives the connecting rod 216 and the piston 215 to do reciprocating motion in the first chamber 218 of the cylinder 217.

Furthermore, in FIGS. 1 and 2, the outlet nozzle 22 is connected to the first chamber 218; and the housing 1 is divided into a second chamber 11 and a third chamber 12 by the compressor device 2; the fan 212 and the outlet nozzle 22 are located in the second chamber 11. In the present application, as shown in FIGS. 4 and 5, FIGS. 4 and 5 show the structure of the air inflating device shown in FIG. 1. The air inflating device further comprises a separation barrier 3 that is arranged in the housing 1. The separation barrier 3 has a second fixing hole 31 and a third fixing hole 32; and the motor 211 is arranged in the second fixing hole 31, and the cylinder 217 is arranged in the third fixing hole 32. The second chamber 11 and the third chamber 12 are separated completely via the separation barrier 3 and the compressor device 2.

For the compressor device 2 adopts the U-shaped design, the distance between the fan 212 and the outlet nozzle 22 which is a hotspot is minimized. Since the distance is minimized, the cooling effect on the hotspot by convection driven by the fan is maximized. Thus, the operating temperature of the compressor device 2 is lower compared with the conventional design and a desired lower surface temperature of the compressor device 2 is achieved. Furthermore, According to the thermodynamic, the compression of air inside the cylinder 217 is exothermic. It implies that the compression is favored at a lower temperature.

As the operating temperature of the compressor device 2 of the present application is lower, the compression of the compressor device 2 is favored, which results in lower energy consumption and shorter tire inflation time.

Furthermore, in FIGS. 1, 2, 4 and 5, the housing 1 has one or more ventilation holes 13 for air from surrounding to enter and leave the second chamber 11. The one or more ventilation holes 13 and the second chamber 11 form an air flow path; and the air flow path is driven by the fan 212 and passing through a surface of the outlet nozzle 22 as a measure of improving heat dissipation. Moreover, the housing 1 has one or more air intake holes 14 to take air from surrounding to the first chamber 218.

Besides, the outlet nozzle 22 is a straight outlet nozzle, which eliminates a heat generation effect that is due to collision of compressed air particles on the pipe wall of a conventional 90 degree bended outlet nozzle.

As shown in FIGS. 6-7, in another embodiment, the first bevel gear 213 is replaced by a first helical gear 233, and the second bevel gear 214 is replaced by a second helical gear 234 engaging with the first helical gear 233.

The present application further provides a tire repair machine, and the tire repair machine comprises the air inflating device.

The present application further provides a manufacturing method of an air inflating device to inflate air into a tire; the air inflating device comprises a fan mounted on a motor, a compressor main body driven by the motor and configured for generating compressed air, an outlet nozzle serving as a compressed air discharge opening and a housing accommodating the fan, the motor, the compressor main body and the outlet nozzle;

the manufacturing method comprises dividing the housing into a second chamber and a third chamber to make an air compression process of the compressor main body be done in the third chamber, and making the fan and the outlet nozzle be located in the second chamber and be aligned in a straight line, so that air flow generated by the fan cools the outlet nozzle directly;

the manufacturing method further comprises setting one or more ventilation holes on the second chamber to make the one or more ventilation holes and the second chamber form an air flow path for air from surrounding to enter and leave the second chamber, and setting one or more air intake holes on the third chamber to take air from surrounding to the first chamber.

INDUSTRIAL APPLICABILITY

The air inflating device and the tire repair machine of the present application adopt a U-shaped compressor device as an air inflating mechanism, which reduces the volume of the air inflation device; and in the compressor device, an outlet nozzle and a piston are separated, which promote heat dissipation of the air inflating device. The air inflating device and the tire repair machine of the present application has a simple structure and a strong practicality.

The invention claimed is:

1. An air inflating device comprising:

a housing, a compressor device including:

a compressor main body configured for generating compressed air, an outlet nozzle that is connected to the compressor main body as a compressed air discharge opening, and a pressure gauge configured for measuring a pressure of the compressed air from the compressor main body;

wherein the compressor main body includes:

a motor, a fan mounted on the motor, a first bevel gear driven by the motor via a first rotation shaft, a second bevel gear engaging with the first bevel gear, a piston driven by the second bevel gear via a connecting rod, and a cylinder equipped with the piston in a reciprocal manner and forming a first chamber for compressing air inside to generating compressed air;

the outlet nozzle is connected to the first chamber; the compressor device is stored in the housing, and the housing is divided into a second chamber and a third chamber by the compressor device; the fan and the outlet nozzle are located in the second chamber, positioned entirely inside the housing;

the housing has one or more ventilation holes for air from a surroundings to enter and leave the second chamber;

the housing has one or more air intake holes to take air from the surroundings to the first chamber;

the motor and the outlet nozzle adopt a U-shaped design so that the fan is adjacent the outlet nozzle in a parallel axial direction and positioned entirely inside the housing;

the ventilation holes and the second chamber form an air flow path which is driven by the fan and passes over a surface of the outlet nozzle.

2. The air inflating device according to claim 1, wherein the compressor main body further includes a bearing and a second rotation shaft; an outer ring of the bearing is mounted on the housing, and the second rotation shaft is fixed in an inner ring of the bearing axially; the second bevel gear is mounting on the second rotation shaft axially, and the second rotation shaft is perpendicular to the first rotation shaft.

3. The air inflating device according to claim 2, wherein a load is mounted on the second bevel gear or the second rotation shaft; and the connecting rod is eccentrically mounted on the load.

4. The air inflating device according to claim 1, wherein a shaft axis of the first bevel gear and a shaft axis of the second bevel gear intersect at a shaft angle of 45-120 degrees.

5. The air inflating device according to claim 1, further comprising a separation barrier that is arranged in the housing; and the separation barrier has a second fixing hole and a third fixing hole; and the motor is arranged in the second fixing hole, and the cylinder is arranged in the third fixing hole; the second chamber and the third chamber are separated completely via the separation barrier and the compressor device.

6. A tire repair machine comprising the air inflating device according to claim 1.

7. The tire repair machine according to claim 6, wherein the compressor main body further includes a bearing and a second rotation shaft; an outer ring of the bearing is mounted on the housing, and the second rotation shaft is fixed in an inner ring of the bearing axially; the second bevel gear is mounting on the second rotation shaft axially, and the second rotation shaft is perpendicular to the first rotation shaft.

8. The tire repair machine according to claim 7, wherein a load is mounted on the second bevel gear or the second rotation shaft; and the connecting rod is eccentrically mounted on the load.

9. The tire repair machine according to claim 6, wherein a shaft axis of the first bevel gear and a shaft axis of the second bevel gear intersect at a shaft angle of 45-120 degrees.

10. The tire repair machine according to claim 6, wherein the air inflating device further comprises a separation barrier that is arranged in the housing; and the separation barrier has a second fixing hole and a third fixing hole; and the motor is arranged in the second fixing hole, and the cylinder is arranged in the third fixing hole; the second chamber and the third chamber are separated completely via the separation barrier and the compressor device.

11. An air inflating device comprising:

a housing, a compressor device including:

a compressor main body configured for generating compressed air, an outlet nozzle that is connected to the compressor main body as a compressed air discharge opening, and a pressure gauge configured for measuring a pressure of the compressed air from the compressor main body;

wherein the compressor main body includes:

a motor, a fan mounted on the motor, a first helical gear driven by the motor via a first rotation shaft, a second helical gear engaging with the first helical gear, a piston driven by the second helical gear via a connecting rod, and a cylinder equipped with the piston in a reciprocal manner and forming a first chamber for compressing air inside to generating compressed air;

the outlet nozzle is connected to the first chamber; the compressor device is stored in the housing, and the housing is divided into a second chamber and a third chamber by the compressor device; the fan and the outlet nozzle are located in the second chamber such that the fan is adjacent the outlet nozzle in parallel axial direction and positioned entirely inside the housing.

12. The air inflating device according to claim 11, wherein the housing has one or more ventilation holes for air from surroundings to enter and leave the second chamber.

13. The air inflating device according to claim 12, wherein the housing has one or more air intake holes to take air from a surroundings to the first chamber.

14. The air inflating device according to claim 11, wherein the housing has one or more air intake holes to take air from a surroundings to the first chamber.

15. The air inflating device according to claim 11, wherein the compressor main body further includes a bearing and a second rotation shaft; an outer ring of the bearing is mounted on the housing, and the second rotation shaft is fixed in an inner ring of the bearing axially; the second helical gear is mounting on the second rotation shaft axially, and the second rotation shaft is perpendicular to the first rotation shaft.

16. The air inflating device according to claim 15, wherein a load is mounted on the second helical gear or the second rotation shaft; and the connecting rod is eccentrically mounted on the load.

17. The air inflating device according to claim 11, further comprising a separation barrier that is arranged in the housing; and the separation barrier has a second fixing hole and a third fixing hole; and the motor is arranged in the second fixing hole, and the cylinder is arranged in the third fixing hole; the second chamber and the third chamber are separated completely via the separation barrier and the compressor device.

18. A tire repair machine comprising the air inflating device according to claim 11.

19. The tire repair machine according to claim 18, wherein the housing has one or more ventilation holes for air from surroundings to enter and leave the second chamber.

20. A manufacturing method of an air inflating device to inflate air into a tire, wherein the air inflating device comprises a fan mounted on a motor, a compressor main body driven by the motor and configured for generating compressed air, an outlet nozzle serving as a compressed air discharge opening and a housing accommodating the fan, the motor, the compressor main body and the outlet nozzle;

the manufacturing method comprises:

dividing the housing into a second chamber and a third chamber to make an air compression process of the compressor main body be done in the third chamber, and making the fan and the outlet nozzle be located in the second chamber and be aligned in a straight line, so that air flow generated by the fan cools the outlet nozzle directly, wherein the fan and the outlet nozzle are in parallel axial direction and are positioned entirely inside the housing;

setting one or more ventilation holes on the second chamber to make the one or more ventilation holes and the second chamber form an air flow path for air from surroundings to enter and leave the second chamber, and setting one or more air intake holes on the third chamber to take air from surroundings to the first chamber.

* * * * *